US006883480B1

(12) United States Patent
Sluka et al.

(10) Patent No.: US 6,883,480 B1
(45) Date of Patent: Apr. 26, 2005

(54) CAMSHAFT ADJUSTER FOR INTERNAL COMBUSTION ENGINES OF MOTOR VEHICLES

(75) Inventors: Gerold Sluka, Nurtingen (DE); Guido Schneider, Altenstadt (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 0 days.

(21) Appl. No.: 10/707,530

(22) Filed: Dec. 19, 2003

(51) Int. Cl.[7] ..... F01L 1/34

(52) U.S. Cl. ..... 123/90.17; 123/90.16; 123/90.34; 92/85 R; 92/122; 464/1; 464/2; 464/160

(58) Field of Search ..... 123/90.17, 90.15–90.18, 123/90.27, 90.31, 90.34; 464/1, 2, 160; 92/5 L, 92/5 R, 6 R, 85 R, 120, 121, 122; 74/568 R

(56) References Cited

U.S. PATENT DOCUMENTS 5,836,276 A * 11/1998 Iwasaki et al. ..... 123/90.17
6,390,043 B1 * 5/2002 Niethammer et al. .... 123/90.17
6,668,777 B1 * 12/2003 Sluka et al. ..... 123/90.17

* cited by examiner

*Primary Examiner*—Thomas Denion
*Assistant Examiner*—Kyle M. Riddle
(74) *Attorney, Agent, or Firm*—Gudrun E. Huckett

(57) ABSTRACT

A camshaft adjuster for internal combustion engines of motor vehicles has a stator having a casing and stays connected to the casing and projecting radially inwardly. A rotor rotatable relative to the stator is fastened on the camshaft. The rotor has a rotor base member and vanes connected thereto. The vanes project into spaces between the stator stays. The stays each have an end face that rest sealingly against the rotor base member. The vanes of the rotor each have an end face resting sealingly against an inner peripheral wall of the stator. At least one of the vanes of the rotor has a damping element and the stator has at least one counter damping element. Upon rotation of the rotor into its end position, the damping element interacts with the counter damping element and slows the movement of the rotor into the end position.

12 Claims, 1 Drawing Sheet

CAMSHAFT ADJUSTER FOR INTERNAL COMBUSTION ENGINES OF MOTOR VEHICLES

BACKGROUND OF INVENTION

1. Field of the Invention

The invention relates to a camshaft adjuster for internal combustion engines of motor vehicles, comprising a stator with a casing and stays that project radially inwardly from the casing, wherein the vanes of a rotor project into the spaces defined between the stays of the stator. The rotor is rotatable relative to the stator and is fixedly connected to the camshaft of an engine. The rotor has a rotor base member against which the end faces of the stays of the stator rest sealingly. The vanes of the rotor rest sealingly with their end faces against the inner peripheral wall of the stator.

2. Description of the Related Art

Camshaft adjusters are provided in order to change the opening time of the intake valves of an internal combustion engine of a motor vehicle as a function of the demand on the engine output. The rotor that is seated fixedly on the camshaft is rotated relative to the stator for camshaft adjustment in that the rotor vanes are loaded by a pressure medium. The rotor vanes can be rotated until their lateral surfaces contact the lateral walls of the stator stays. In the end position, the rotor vanes impact on the stator stays so that a disturbing impact noise results.

SUMMARY OF INVENTION

It is an object of the present invention to configure a camshaft adjuster of the aforementioned kind such that it operates silently.

In accordance with the present invention, this is achieved in that at least one of the vanes of the rotor has at least one damping element that, upon rotation of the rotor into its end position, interacts with at least one counter damping element of the stator.

In the camshaft adjuster according to the invention, the damping element and the counter damping element ensure that, when the rotor approaches its end position, its kinetic energy is reduced so that it rotates slowly into its end position. In this way, the rotor vane will contact gently the sidewall of the corresponding stator stay. The pressure medium that is located between the damping element and the counter damping element, when the two elements interact, will escape only throttled so that a high damping action will result.

DETAILED DESCRIPTION

The camshaft adjuster is part of a camshaft adjusting device for controlling the timing of the opening and closing action of intake valves of an internal combustion engine of a motor vehicle as a function of the momentary output demand of the internal combustion engine.

Figure 2:
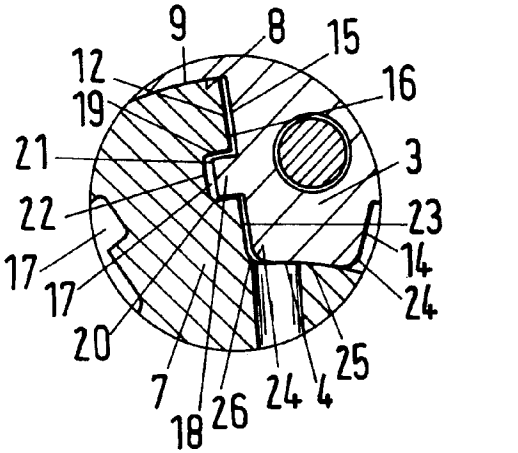
FIG. 2 shows the detail Y of FIG. 1 in an enlarged representation.
Figure 1:
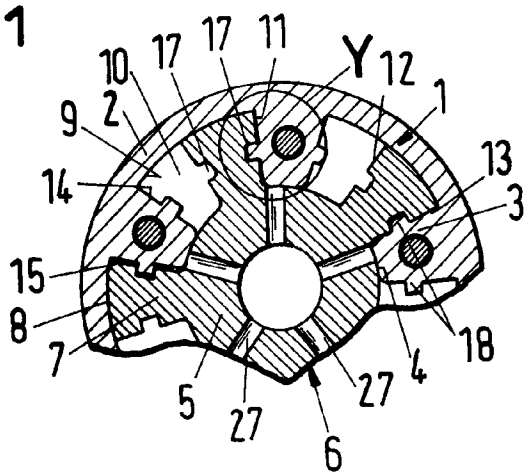
FIG. 1 shows in radial section a part of a first embodiment of the camshaft adjuster according to the invention.

The camshaft adjuster according to FIGS. 1 and 2 has a stator 1 with a cylindrical casing 2 having stays 3 that project from the inner side of the casing radially inwardly and are positioned at a uniform spacing relative to one another. They are positioned with their end faces 4 sealingly against the cylindrical rotor base member 5 of a rotor 6 that is fixedly connected to the camshaft. The vanes 7 project radially away from the rotor base member 5 and rest with their end faces 8 sealingly against the inner wall 9 of the stator casing 2. The rotor vanes 7 project into a space between two neighboring stator stays 3, respectively. The space between neighboring stays 3 is separated by the rotor vanes 7 into two pressure chambers 10, 11. A pressure medium can be supplied into the chambers 10 and 11, respectively. By means of the pressure medium, the first vane sidewall 12 or the second vane sidewall 13 of the rotor vane 7 is loaded in order to rotate the rotor 6 relative to the stator 1. The rotor 6 can be rotated relative to the stator 1 maximally to such an extent that the sidewalls 12 or 13 contact the corresponding stay sidewalls 14 or 15 of the stator stays 3.

In order for the rotor vanes 7 to contact the stay sidewalls 14 or 15 of the stator stays 3 in a dampened fashion, the camshaft adjuster is provided with an end position damping means. In this connection, the rotor 6 is configured such that advantageously only one of its vanes 7 impacts on the corresponding stay sidewall 14, 15 of the respective stator stay 3 in the end position in order to ensure in this way a precise end position of the rotor 6. The other rotor vanes 7 are embodied such that between the corresponding vane sidewall 12 for 13 of the rotor vanes 7 and the neighboring stay sidewall 14, 15 of the respective stator stay 3 a damping gap 16 (FIG. 2) remains.

In the vane sidewalls 11, 12 of the rotor vanes 7 a groove 17 is provided approximately at half the radial length. The groove 17 extends across the axial width of the vane sidewall 12, 13 and, viewed in radial section, has a rectangular cross-section. Into this groove 17 a projection 18 projects in the end position. The projection 18 is provided approximately at half the radial length of the stay sidewalls 14, 15 of the stator stay 3.

As shown in FIG. 2, the projections 18 on the stay sidewalls 14, 15 of the stator stays 3 are arranged such that their spacing relative to the radial outer limiting wall 19 of the grooves 17 is smaller than their spacing relative to the radial inner limiting wall 20. The end face 21 of the projections 18 that are rectangular in cross-section has a spacing from the bottom 22 of the grooves 17. In the remaining area, the vane sidewalls 12, 13 of the rotor vanes 7 have a spacing from the neighboring stay sidewalls 14, 15 of the stator stays 3, respectively. The gap 23 that is thus formed across the radial length of the rotor vanes 7 and the stator stays 3 provides the end position damping action of the camshaft adjuster. When the rotor 6 is rotated such that it approaches with the corresponding vane sidewall 12 or 13 of its vanes 7 the corresponding stay sidewalls 14, 15 of the stator stays 3, the pressure medium contained in the pressure chamber 10 or 11, depending on the rotational direction of the rotor 6, is displaced. As soon as the projections 18 of the stator stays 3 engage the grooves 17 of the rotor vanes 7, damping of the rotational movement of the rotor 6 as a result of the damping gap 23 occurs. In this way, the kinetic energy of the rotor 6 is reduced so that it moves slowly into its end position.

As illustrated in FIG. 2, the transition 24 between the stay sidewalls 14 or 15 and the end face 4 of the stator stays 3 is rounded. Also, the vane sidewalls 12, 13 of the rotor vanes 7 pass with a rounded portion into the outer peripheral surface 25 of the rotor base member 5. The transition 26 of the rotor vanes 7 formed in this way has a smaller radius of curvature than the transition 24 of the stator stays 3. The rotor base member 5 has radially positioned bores 27 through which the pressure medium is displaced out of the pressure chamber 11. These bores 27 open in the transition area 26 of the rotor 6. As a result of the different radii of curvature of the transitions 24 and 26 of the stator 1 and the rotor 6, an optimal damping action is achieved also in this area. In the end position of the rotor 6, in this area a lunate or crescent-shaped space is formed that opens into the respective bore 27 and ensures that upon switching of the camshaft adjuster the pressure medium can flow via the bores 27 and this crescent-shaped area to the vane sidewall 12 of the rotor vanes 7 so that the rotor 6 can be rotated in a counter-clockwise direction away from the end position illustrated in FIGS. 1 and 2.

Since the lateral projections 18 of the stator stays 3 are provided approximately at half the radial width, the end face 4 of the stator stays 3 extends about a relatively large peripheral angle. In this way, a long sealing gap between the end face 4 of the stay 3 and the peripheral surface 25 of the rotor base member 5 is formed. Accordingly, the sealing gap formed between the end face 8 of the rotor vanes 7 and the inner wall 9 of the stator casing 2 in the circumferential direction is also great because the grooves 17 do not cause a shortening of this sealing gap.

Figure 4:
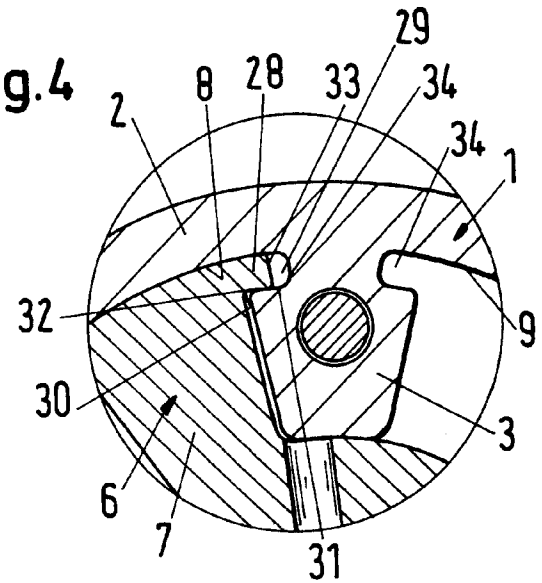
FIG. 4 shows the detail X of FIG. 3 in an enlarged representation.
Figure 3:
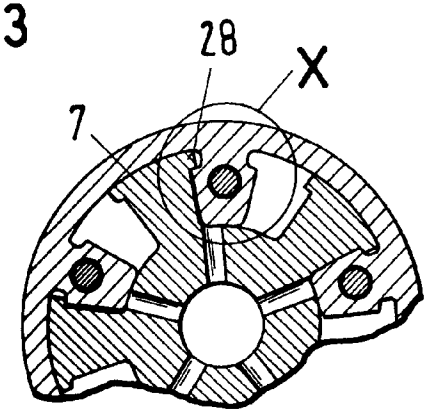
FIG. 3 shows in a representation corresponding to FIG. 1 a second embodiment of the camshaft adjuster according to the invention.

In the embodiment according to FIGS. 3 and 4, the rotor vanes 7 are provided at their radial outer ends with projections 28 extending in the circumferential direction and engaging in the end position of the rotor 6 the grooves 29 which are provided at the radial outer end of the stays 3 of the stator 1. These grooves 29 are limited radially outwardly by the inner wall 9 of the stator casing 2. In other respects, the rotor vanes 7 and the stator stays 3 are configured identically to the embodiment of FIGS. 1 and 2.

The projections 28 are provided such that their radial outer side forms an extension of the end face 8 of the rotor vane 7. In this way, the sealing gap formed between this end face 8 and the inner wall 9 of the stator casing 2, in comparison to the preceding embodiment, is enlarged so that leakage losses are kept very small. The projections 28 have a width in the radial direction such that between their radial inner side 30 and the neighboring lateral surface 31 of the grooves 29 only a very narrow damping gap 32 is formed; this leads to an optimal damping of the rotor 6. In the circumferential direction the depth of the grooves 29 is greater than the corresponding length of the projections 28. In this way, it is ensured that the projections 28 in the end position of the rotor 6 do not impact with their end faces 33 against the bottom 34 of the grooves 29. Between the end face 33 and the bottom 34 there remains a space that is filled with the pressure medium; this space contributes to the optimal damping action for the rotor 6.

The rotor vanes 7 and the stator stays 3 have sufficient width in the circumferential direction so that high stiffness of the rotor vanes is ensured.

While specific embodiments of the invention have been shown and described in detail to illustrate the inventive principles, it will be understood that the invention may be embodied otherwise without departing from such principles.

What is claimed is:

1. A camshaft adjustor for internal combustion engines of motor vehicles, the camshaft adjustor comprising:

a stator having a casing and stays connected to the casing and projecting radially inwardly;

a rotor rotatable relative to the stator and configured to be fastened on a camshaft of an internal combustion engine;

wherein the rotor has a rotor base member and vanes connected to the rotor base member;

wherein the vanes project into spaces between the stays of the stator, respectively;

wherein the stays each have an end face that rest sealingly against the rotor base member of the rotor;

wherein the vanes of the rotor each have an end face resting sealingly against an inner peripheral wall of the stator;

wherein at least one of the vanes of the rotor has at least one damping element and wherein the stator has at least one counter damping element, wherein upon rotation of the rotor into an end position of the rotor the at least one damping element interacts with the at least one counter damping element;

wherein the at least one damping element is a groove provided in a vane sidewall of the at least one rotor vane;

wherein the at least one damping element is provided at a spacing from the end face of the at least one rotor vane;

wherein the at least one damping element is provided at approximately half a radial length of the vane sidewall of the rotor vane.

2. The camshaft adjuster according to claim 1, wherein the at least one counter damping element is a projection projecting in a circumferential direction of the stator from a stay sidewall of one of the stays.

3. The camshaft adjuster according to claim 1, wherein the at least one rotor vane has vane sidewalls having rounded portions connecting the vane sidewalls to an outer peripheral surface of the rotor base member.

4. The camshaft adjuster according to claim 3, wherein stay sidewalls of at least one of the stays have rounded portions connecting the stay sidewalls to the end face of the at least one stay.

5. The camshaft adjuster according to claim 3, wherein the rotor base member has at least one bore opening at a location of the rounded portions of the vane sidewalls of the at least one rotor vane, wherein the at least one bore supplies a pressure medium.

6. A camshaft adjuster for internal combustion engines of motor vehicles, the camshaft adjustor comprising:

a stator having a casing and stays connected to the casing and projecting radially inwardly;

a rotor rotatable relative to the stator and configured to be fastened on a camshaft of an internal combustion engine;

wherein the rotor has a rotor base member and vanes connected to the rotor base member;

wherein the vanes project into spaces between the stays of the stator, respectively;

wherein the stavs each have an end face that rest sealingly against the rotor base member of the rotor;

wherein the vanes of the rotor each have an end face resting sealingly against an inner peripheral wall of the stator;

wherein at least one of the vanes of the rotor has at least one damping element and wherein the stator has at least one counter damping element, wherein upon rotation of the rotor into an end position of the rotor the at least one damping element interacts with the at least one counter damping element;

wherein the at least one damping element is projection on a vane sidewall of the at least one rotor vane, wherein the projection extends in a circumferential direction of the rotor;

wherein the at least one damping element is provided on a radial outer end of the vane sidewall of the at least one rotor vane.

7. The camshaft adjuster according to claim 6, wherein the at least one counter damping element is a groove in stay sidewalls of at least one of the stays, wherein the groove extends in the circumferential direction of the stator.

8. The camshaft adjuster according to claim 6, wherein the at least one rotor vane has vane sidewalls having rounded portions connecting the vane sidewalls to an outer peripheral surface of the rotor base member.

9. The camshaft adjuster according to claim 8, wherein stay sidewalls of at least one of the stays have rounded portions connecting the stay sidewalls to the end face of the at least one stay.

10. The camshaft adjuster according to claim 8, wherein the rotor base member has at least one bore opening at a location of the rounded portions of the vane sidewalls of the at least one rotor vane, wherein the at least one bore supplies a pressure medium.

11. Camshaft adjuster for internal combustion engines of motor vehicles, the camshaft adjustor comprising:

a stator having a casing and stays connected to the casing and projecting radially inwardly;

a rotor rotatable relative to the stator and configured to be fastened on a camshaft of an internal combustion engine;

wherein the rotor has a rotor base member and vanes connected to the rotor base member;

wherein the vanes project into spaces between the stays of the stator, respectively;

wherein the stays each have an end face that rest sealingly against the rotor base member of the rotor;

wherein the vanes of the rotor each have an end face resting sealing against an inner peripheral wall of the stator;

wherein at least one of the vanes of the rotor has at least one damping element and wherein the stator has at least one counter damping element, wherein upon rotation of the rotor into an end position of the rotor the at least one damping element interacts with the at least one counter damping element;

wherein the at least one rotor vane has vane sidewalls having rounded portions connecting the vane sidewalls to an outer peripheral surface of the rotor base member;

wherein stay sidewalls of at least one of the stays have rounded portions connecting the stay sidewalls to the end face of the at least one stay;

wherein a radius of curvature of the rounded portions of the at least one rotor vane is smaller than a radius of curvature of the rounded portions of the at least one stay.

12. A camshaft adjuster for internal combustion engines of motor vehicles, the camshaft adjustor comprising:

a stator having a casing and stays connected to the casing and projecting radially inwardly;

a rotor rotatable relative to the stator and configured to be fastened on a camshaft of an internal combustion engine;

wherein the rotor has a rotor base member and vanes connected to the rotor base member;

wherein the vanes project into spaces between the stays of the stator, respectively;

wherein the stays each have an end face that rest sealingly against the rotor base member of the rotor;

wherein the vanes of the rotor each have an end face resting sealingly against an inner peripheral wall of the stator;

wherein at least one of the vanes of the rotor has at least one damping element and wherein the stator has at least one counter damping element, wherein upon rotation of the rotor into an end position of the rotor the at least one damping element interacts with the at least one counter damping element;

wherein the at least one rotor vane has vane sidewalls that are planar adjacent to the at least one damping element provided in the vane sidewalls, and wherein the at least one counter damping element is provided in stay sidewalls of one of the stays, wherein the stay sidewalls of the stay adjacent to the counter damping element are planar.

* * * * *